US008926391B2

(12) United States Patent
Rodriguez

(10) Patent No.: US 8,926,391 B2
(45) Date of Patent: Jan. 6, 2015

(54) PRINTABLE FACIAL MASK AND PRINTABLE FACIAL MASK SYSTEM WITH ENHANCED PERIPHERAL VISIBILITY

(75) Inventor: Luis Joaquin Rodriguez, South Orange, NJ (US)

(73) Assignee: Luis J. Rodriguez, South Orange, NJ (US)

( * ) Notice: Subject to any disclaimer, the term of this patent is extended or adjusted under 35 U.S.C. 154(b) by 644 days.

(21) Appl. No.: 13/282,168

(22) Filed: Oct. 26, 2011

(65) Prior Publication Data

US 2012/0102621 A1 May 3, 2012

Related U.S. Application Data

(60) Provisional application No. 61/407,096, filed on Oct. 27, 2010, provisional application No. 61/483,793, filed on May 9, 2011.

(51) Int. Cl.
*A63H 33/00* (2006.01)
*A41G 7/00* (2006.01)

(52) U.S. Cl.
CPC ..... *A41G 7/00* (2013.01)
USPC ..... 446/27

(58) Field of Classification Search
USPC ..... 446/26, 27; 2/173, 206
See application file for complete search history.

(56) References Cited

U.S. PATENT DOCUMENTS

| | | | | | |
|---|---|---|---|---|---|
| 2,021,593 | A | * | 11/1935 | Einson | 2/206 |
| 2,441,333 | A | | 5/1948 | Reinsberg | |
| 2,677,133 | A | * | 5/1954 | Hoffman, Jr. | 2/206 |
| 2,711,541 | A | * | 6/1955 | Bellett | 2/206 |
| 2,964,757 | A | * | 12/1960 | Jarvis | 2/173 |
| 3,215,322 | A | * | 11/1965 | Boyer et al. | 224/610 |
| 3,717,882 | A | | 2/1973 | Schuessler | |
| 4,121,304 | A | * | 10/1978 | Cooper | 2/206 |
| 5,009,626 | A | * | 4/1991 | Katz | 446/391 |
| 5,035,004 | A | * | 7/1991 | Koester | 2/206 |
| 5,072,460 | A | * | 12/1991 | Weder | 2/206 |
| 5,465,427 | A | * | 11/1995 | Shields | 2/206 |
| 5,546,604 | A | | 8/1996 | Geller | |
| 5,619,753 | A | | 4/1997 | Van Cort | |
| 5,906,005 | A | * | 5/1999 | Niskala et al. | 2/206 |
| 5,933,869 | A | | 8/1999 | Allen | |
| 6,505,351 | B2 | | 1/2003 | Yeh | |
| 6,574,801 | B1 | * | 6/2003 | Harens et al. | 2/206 |
| 6,662,376 | B2 | * | 12/2003 | Cook | 2/206 |
| 6,671,886 | B1 | | 1/2004 | Reitz | |
| 6,832,392 | B2 | | 12/2004 | Palmer et al. | |
| 2006/0242749 | A1 | * | 11/2006 | Penzarella | 2/75 |
| 2007/0101473 | A1 | * | 5/2007 | Henderson | 2/69 |
| 2010/0239625 | A1 | | 9/2010 | Puckett et al. | |
| 2011/0023214 | A1 | * | 2/2011 | Hubbard et al. | 2/173 |

* cited by examiner

*Primary Examiner* — Kurt Fernstrom

(57) ABSTRACT

A mask that is printed on a flexible substrate material, or a flexible substrate material assembly of layers so all facial features can be substantially depicted. A plurality of clear areas void of any printing allows to see through the substrate or the substrate assembly of layers. The mask may alternatively depict images other than facial anthropomorphic features, or simply monochrome or patterned abstract designs.

20 Claims, 18 Drawing Sheets

Fig. 10
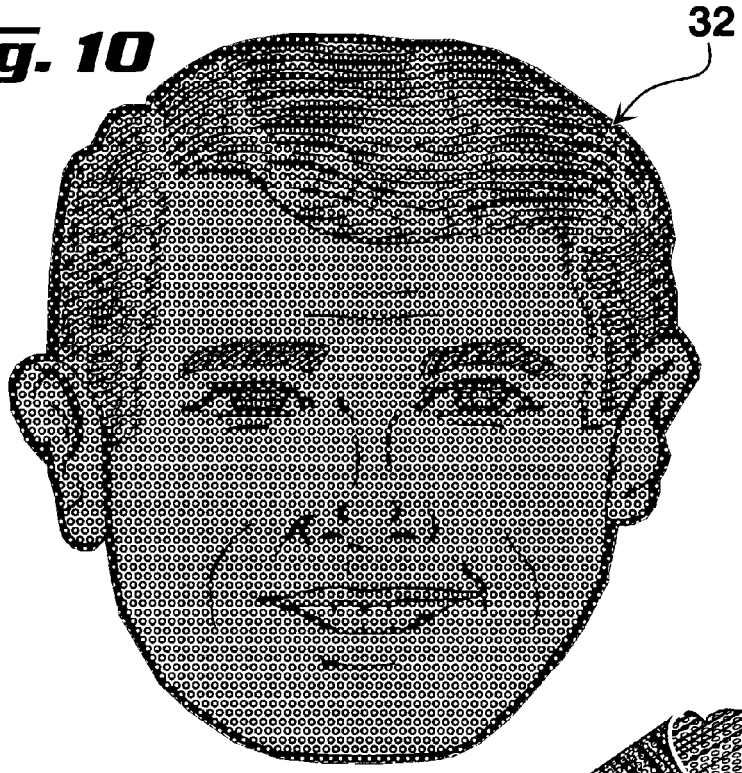
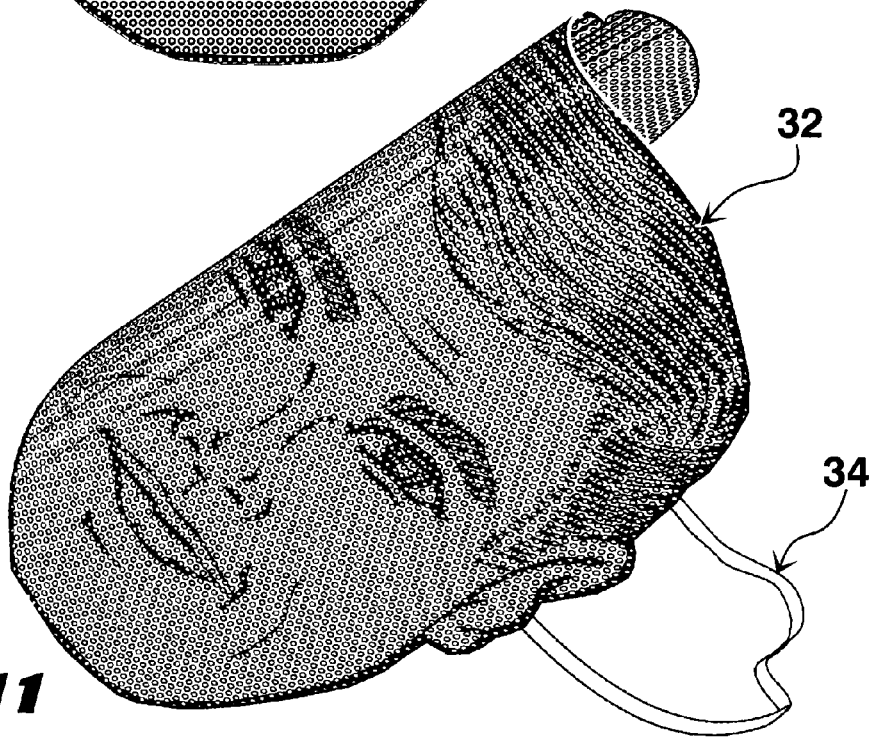
Fig. 11

Fig. 12
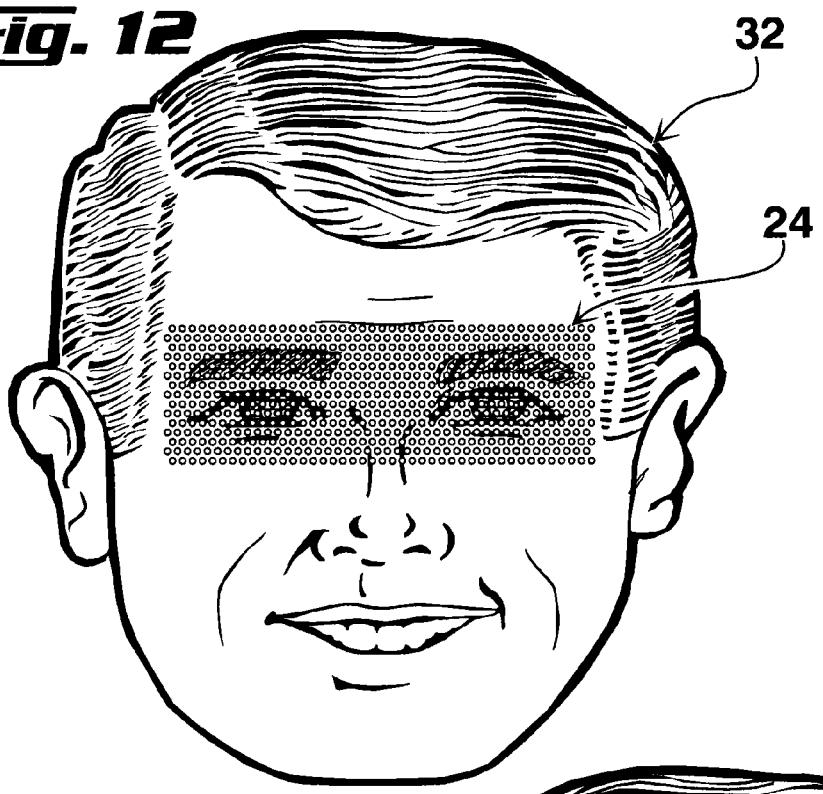
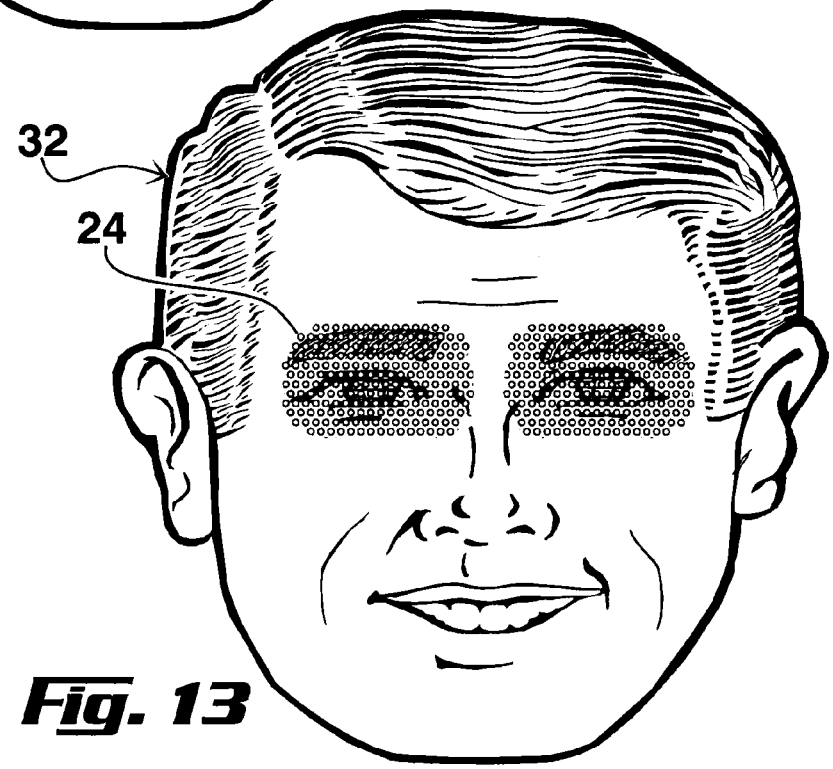
Fig. 13

PRINTABLE FACIAL MASK AND PRINTABLE FACIAL MASK SYSTEM WITH ENHANCED PERIPHERAL VISIBILITY

CROSS REFERENCE TO RELATED APPLICATIONS

This application claims the benefit of U.S. Provisional Application Ser. Nos. 61/407,096, filed Oct. 27, 2010, entitled "TRICKSTICKMAXMASK" and 61/483,793, filed May 9, 2011, entitled "PRINTABLE FACIAL MASK AND PRINTABLE FACIAL MASK SYSTEM WITH ENHANCED PERIPHERAL VISIBILITY", by the present inventor and both of which are herein incorporated by reference.

FIELD OF THE DISCLOSURE

This invention relates to a printable facial mask and a printable facial mask system. And furthermore, to a printable type of mask that also enhances peripheral visibility while being able to display a high quality image to observers.

BACKGROUND OF THE DISCLOSURE

Description of Prior Art

Facial masks are very popular for amusement purposes, especially around certain celebrations, such as Halloween, Mardi Gras, Chinese New Year, and private events, like birthday parties, bachelor parties, political campaigns, sports competitions, etc. Typically, masks of the prior art require fairly large openings in the eyes area to allow visibility. When the mask depicts a particular character, real or fictional, these openings have a defacing effect, as the eyes are the most defining facial feature of any character's identity.

Reducing the size of the openings to enhance appearance only decreases visibility, resulting in a serious safety issue. This is aggravated by the tunnel vision effect these masks of the prior art provide. They offer absolutely no peripheral vision. Visibility in a mask is a very desirable attribute, as shown by the following documents.

In an attempt to address this issue, U.S. Pat. No. 3,717,882 to Schuessler teaches a cap-like face covering made of a stretchable, knitted material with an adjustable opening for the eyes area. In essence, this article simply covers the face of the wearer. It does not portray any different facial features.

In another approach, U.S. Pat. No. 5,035,004 shows a cap and mask combination wherein the mask is defined by a mesh fabric sheet, displaying an image. In this case visibility is highly challenged by the image, ability to ascertain the image is challenged by the wearer's facial features, or both. Peripheral vision is also compromised by the woven texture of the mesh.

U.S. Pat. No. 5,465,427 to Shield discloses a mask that is made of a one-layered substrate, with an inner surface and an outer surface. This mask has some holes for ventilation and purportedly for visibility. However, given the thickness of the material and the necessary density of perforations, to in fact allow visibility it is highly questionable that the final product will result in a practical mask, and that the mask will have an attractive appearance. Furthermore, visibility, specifically peripheral visibility, appears in fact to be highly diminished. Also, given the high and low reliefs of its molded design, It is simply impossible to imprint on the '427 mask. According to the '427 disclosure, the desired indicia needs to be painted. The disclosure states that the painting may be done before or after producing the perforations. It simply appears impossible to apply perforations on an already formed, molded mask in a practical, even and consistent fashion. The disclosure fails to indicate how the perforations are obtained. If that is somehow managed to be doable, painting the mask appears to be a very traumatic and difficult task, regardless of when the painting is done. If it is done before the perforations, the painting will tend to be pealed by the punching pressure exerted. If it is done after the mask is perforated, the paint will tend to cover the perforations.

In another context, US patent application 2010/0239625AI shows a transparent antimicrobial face mask made of clear films to enable view of the nose and mouth of the wearer. This item does not affect the eyes of the wearer. It only allows visibility from other persons.

As established by the foregoing state of the art discussion, there is clearly a need for a mask system which may provide a true depiction of any character, real or fictional, by printing means, while optimizing visibility.

SUMMARY OF THE DISCLOSURE

In accordance with the present invention, a first embodiment of a mask comprises:

1) a clear flexible substrate which is imprinted as per the following steps:
   2) a first layer of white ink or toner is applied. A plurality of blank spots, void of any imprint are provided to the white ink or toner layer, which results in transparent pots, allowing visibility through the clear flexible substrate.
   3) subsequent halftone layers of Cyan, Magenta, Yellow and Black ink or toner reapplied, as per conventional four color printing processes. A plurality of blank spots, devoid of any imprint are provided to the Cyan, Magenta, Yellow, and black ink or toner layers in reciprocal registration and in further registration with the white ink or toner layer, maintaining the transparent spots created by the white ink or toner layer, allowing thereby visibility through the clear flexible substrate. As the flexible substrate is transparent, a similar effect is achieved by inverting the order of ink or toner colors so the image will display through the opposite side of the flexible substrate. For enhanced optical comfort, an optional coating of solid black ink or toner is printed so it faces the wearer eyes.

It is important to note that the four color process is used only as an example, as it is generally the most widely used system at commercial and industrial settings. It is however specifically stated that the principles apply to any printing system, and with disregard of the number of colors used.

4) the mask blank is then produced by a cut around the boundaries of the facial image. In other words, the cut silhouettes the mask. The cutting of the silhouette to define the mask may be achieved by plotters built-in the printing equipment, by die-cut, by hand, or any other available system in the public domain.
   5) accessory means to fasten the mask to a person's head are provided. These means include but are not limited to elastic bands, clips, hats, and handles.

It is important to note that the terms 'ink' and 'toner' are interchangeable and beyond their literal meaning, for the purpose of this application, they indicate any substance capable of imprinting any image or indicia on any given substrate or surface, regardless of their chemical or physical composition. Likewise, the terms 'substrate', 'sheet', 'layer' are interchangeable.

In a second embodiment, the blank spots are obviated. The white layer and the color layers are thoroughly imprinted on the clear substrate. Subsequently, a plurality of orifices is produced on the imprinted clear substrate, so visibility is enabled.

A third embodiment is produced as per the following steps:

1) a white substrate is provided. A pressure sensitive adhesive is provided to the first of the two sides of the white substrate. A release substrate is provided to protect the pressure sensitive adhesive. Since the substrate already has a white foundation, in this scenario it is not necessary to print a white coat.

2) a predetermined image is printed on the second of the two sides of the white substrate.

3) a clear substrate is provided.

4) the protective release substrate is removed from the white substrate after printing the image, and affixed onto the clear substrate.

5) A plurality of orifices is applied to the assembly of the printed white substrate and the clear substrate, so visibility is enabled.

As indicated on the first embodiment example discussion, the mask is then cut and fastening means are provided.

A fourth embodiment may be produced as per the following steps:

1) A clear, flexible sheet material is provided.

2) a first layer of white ink or toner is applied to said flexible sheet material. A plurality of blank spots, void of any imprint are provided to the white ink or toner layer, which results in transparent spots, allowing visibility through the clear flexible substrate.

3) subsequent layers of Cyan, Magenta, Yellow and Black ink or toner are applied, as per conventional four color printing processes. A plurality of blank spots, void of any imprint are provided to the Cyan, Magenta, Yellow, and black ink or toner layer in reciprocal registration and in further registration with the white ink or toner layer, maintaining the transparent spots created by the white ink or toner layer, allowing visibility through the clear flexible substrate.

As indicated on the first embodiment example discussion, the mask is then cut and fastening means are provided Again, other alternative printing systems may be utilized. This includes the use of spot colors, the use of the RGB (Red/Green/Blue) displaying system, or any other system. The plurality of blank, clear spots or perforated orifices to allow visibility is to always be observed, regardless of the number of color layers utilized. All these provisions and clarifications apply to all the embodiments of this invention.

A fifth embodiment is derived from the fourth embodiment. In this scenario, the white substrate had already been perforated with the plurality of orifices prior to affixing to the clear substrate, so visibility is enabled.

It is also possible to produce a mask of a predetermined color already embedded in the flexible material. Likewise, different abstract combination of spot colors, or composite colors may already exist in the substrate material. Also to aid the pupils of the wearer's to remain open for improved vision and comfort, a dark color may be placed on the side of the flexible material facing the wearer's eyes.

It is further to be understood that in any and all embodiments, the plurality of orifices or blank spots (void of ink or toner) may affect the totality of the mask area, or may be restricted to the area of the eyes only. And it must be understood that a number of equivalent variables are possible within the scope of the invention.

OBJECTS AND ADVANTAGES OF THIS INVENTION a) To provide visibility through a mask that covers the entirety of a person's face.

b) To provide visibility through a mask that covers the eyes area of a person.

c) To create the illusion of the eyes of the wearer of a mask to be fully covered.

d) To enhance ability to breath and speak to the person wearing the mask.

e) To enable printing of a mask, so maximum fidelity of the character's features may be depicted.

f) To enable vivid, true and realistic appearance of the subject being portrayed, if such subject is a known character, whether real or fictional.

g) To further stretch this capability relying on photographic means.

h) To further stretch this capability relying on painting and drawing means. This can yet be further expanded by distortions and alterations to result in caricatures of the subject. When implemented, this feature will always impart a 'parody' condition to the mask being portrayed. This further expands the copyrights possibilities of the invention.

i) To enable the depiction of any real or fictional, animated or unanimated, specific or abstract subjects, of course even including a blank mask with no features at all other than a solid color. And this can be done with any color: white, black, pink, orange, etc. Likewise, a predetermined pattern or motif may be printed. In these particular instances, conventional silk screen printing may be considered. Or the pattern or color may already be in the material used.

j) To provide enhanced frontal and peripheral visibility.

k) To enable customized masks. In this scenario, a customer may supply an image in hard copy form or electronic form and the image is adapted to a mask of the present invention, which can be replicated to the quantity requested by the customer. This service may be offered at store locations, kiosks, online, by catalog, mail order, etc.

The above summary of the various representative embodiments of the invention are not intended to describe each illustrated embodiment or every implementation of the invention. Rather, the embodiments are chosen and described so that others skilled in the art can appreciate and understand the principles and practices of the invention. For the purposes of defining individual elements and interpretation of the claims, the definitions and disclosure of the present application are controlling to the extent of any inconsistencies between any related applications having their disclosures incorporated by reference. The figures in the detailed description that follow more particularly exemplify these embodiments.

BRIEF DESCRIPTION OF THE DRAWINGS

FIG. 10 shows a cut-silhouetted mask in plan view.

FIG. 11 depicts the cut-silhouetted mask of FIG. 9 in perspective view, further showing an attached elastic band.

FIG. 12 depicts a frontal view of a mask, just like the mask of FIG. 9, only having perforations in a clustered rectangular shaped area over the eyes zone. The perforations collectively affect both eyes.

FIG. 13 depicts a frontal view of a mask, only having perforations over each eye area, in a separate, clustered fashion.

DETAILED DESCRIPTION

Figure 1:
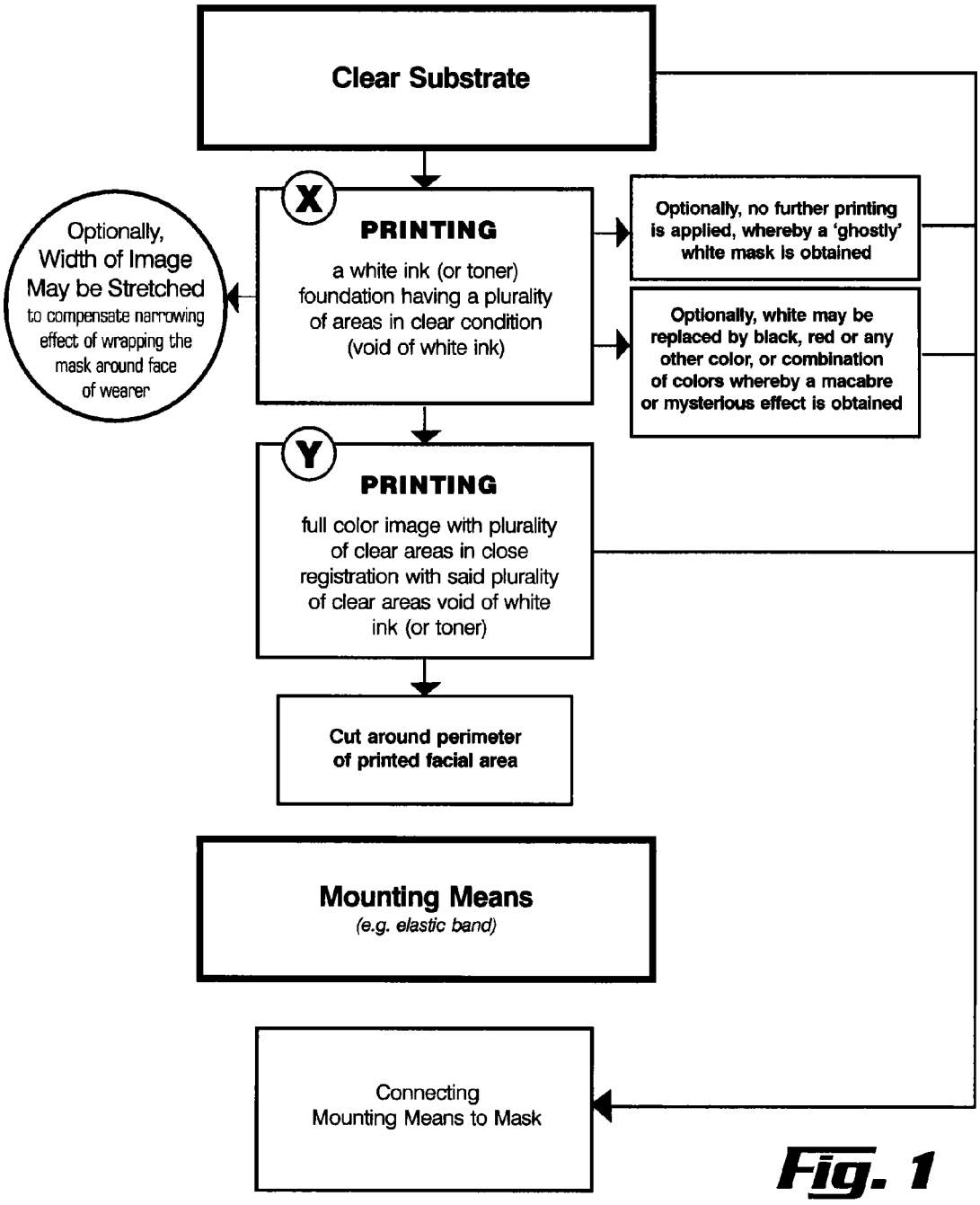
FIG. 1 is a block diagram of the mask of the first embodiment example.

A first embodiment is schematically described in FIG. 1, in a block diagram of a mask printed on one single, independent clear substrate. Steps of production are summarized and the optional step of stretching the width of the face area is also discussed. This optional step is to compensate for the narrowing effect that the mask has when wrapped around a person's face.

Figure 2:
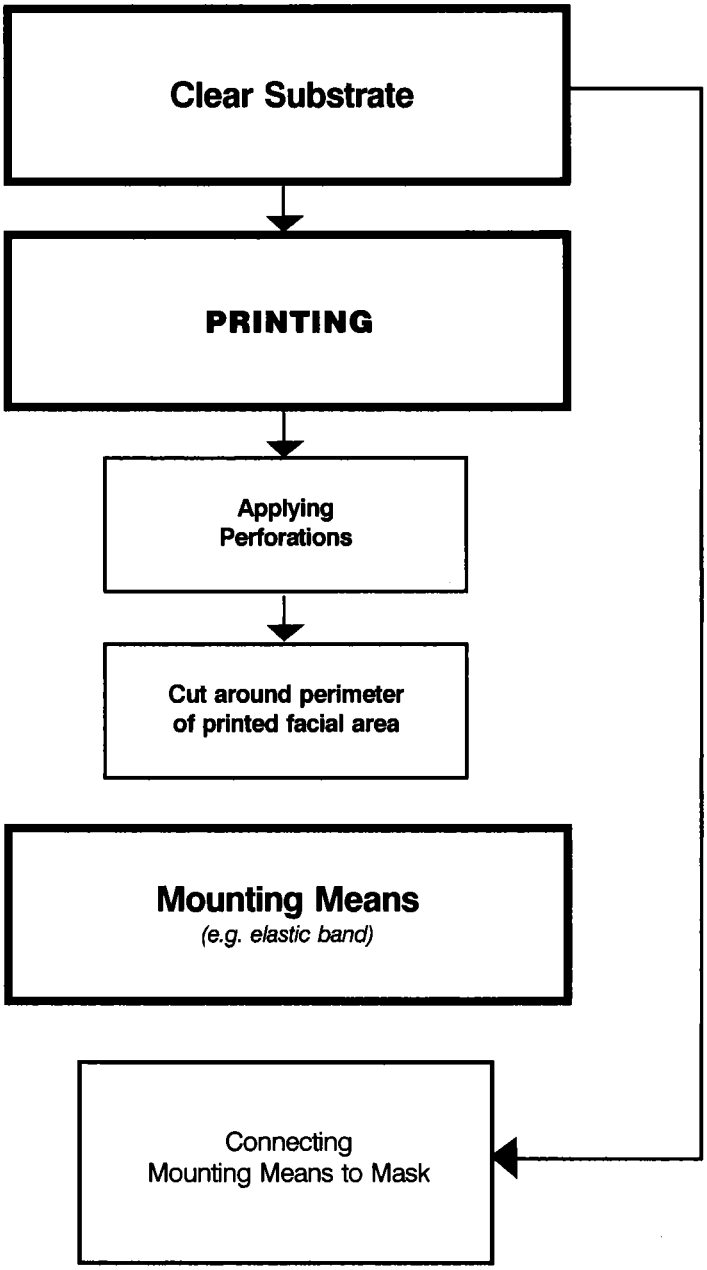
FIG. 2 is a block diagram of the mask of the second embodiment example.

Then, FIG. 2 shows a block diagram of an alternate version of the mask, which receives multiple small perforations after it is printed.

Figure 3:
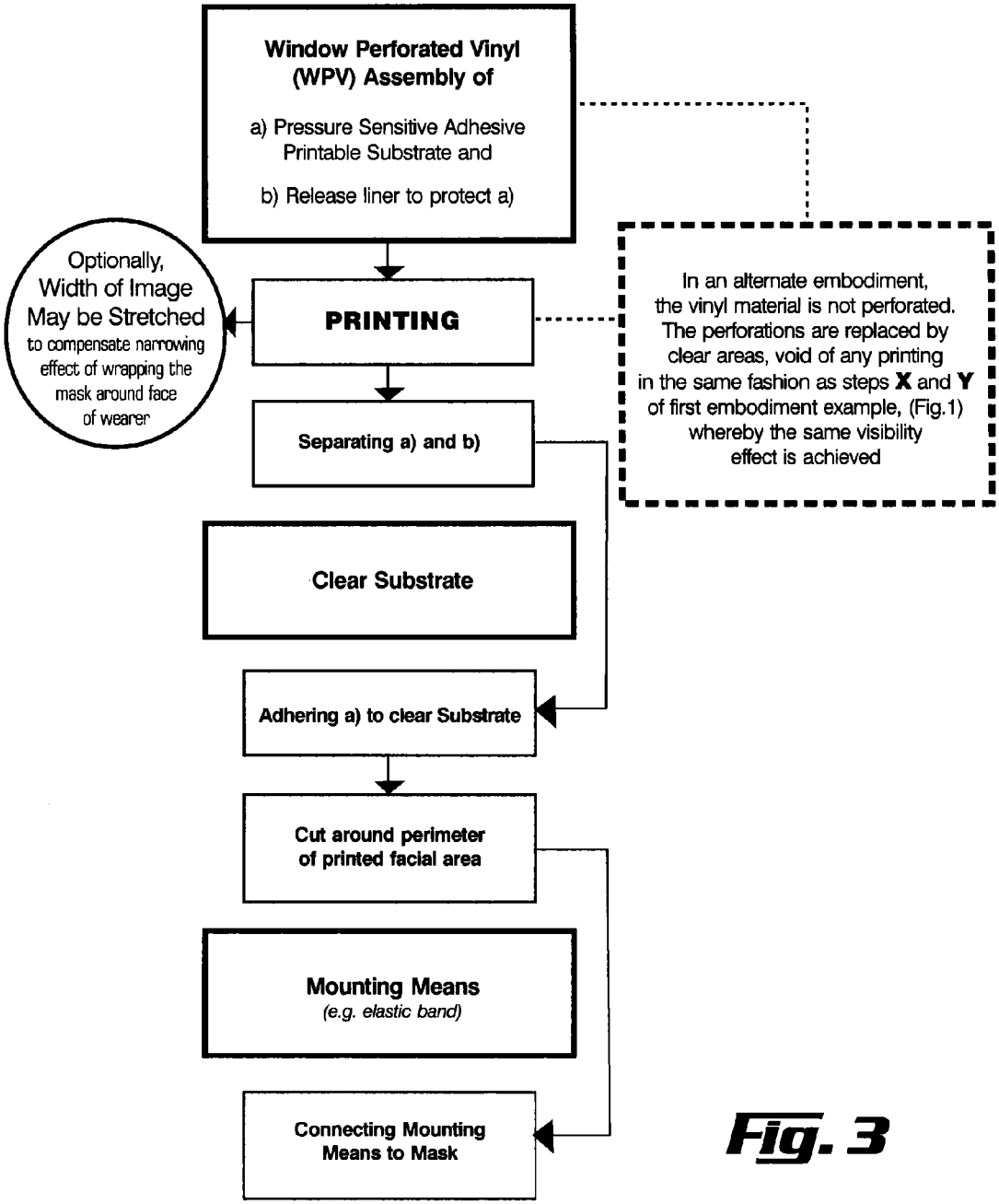
FIG. 3 is a block diagram of the mask of the third embodiment example.

Another example is schematically shown in FIG. 3. In this case, multiple layers to produce the mask are utilized.

The examples submitted are intended as illustrative teachings to enable the production of the invention. It is important to note that different variations may be adapted within the scope of the invention.

Figure 4:
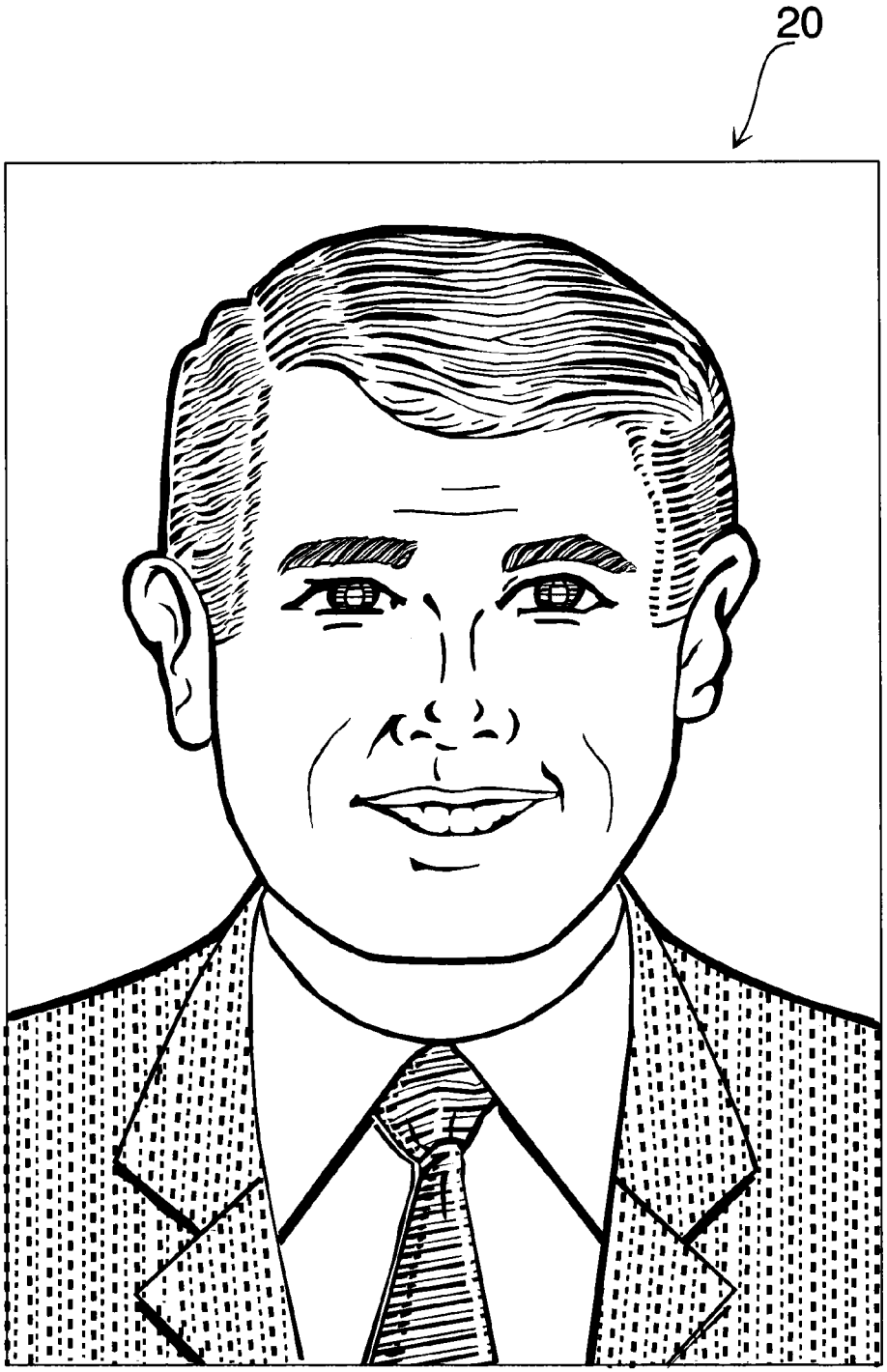
FIG. 4 shows a plan view of an original image to produce a mask. The image is of a substantially frontal view of the torso of a man.

An image is depicted in FIG. 4. The image may be scanned or may be retrieved electronically from the internet, from a digital camera, from a stock library or any other media. It is important to keep in mind that the mask image may be of a real person or a fictional character. It is possible to selectively utilize a photograph, drawing, a painting, a caricature or any other graphic creation. The subject may as well be specific or abstract; animated or inanimated. And for that matter, the mask may simply be a blank spot color or a pattern of color or colors. Obviously the mask may be as selected, monochrome, or polychrome.

Figure 5:
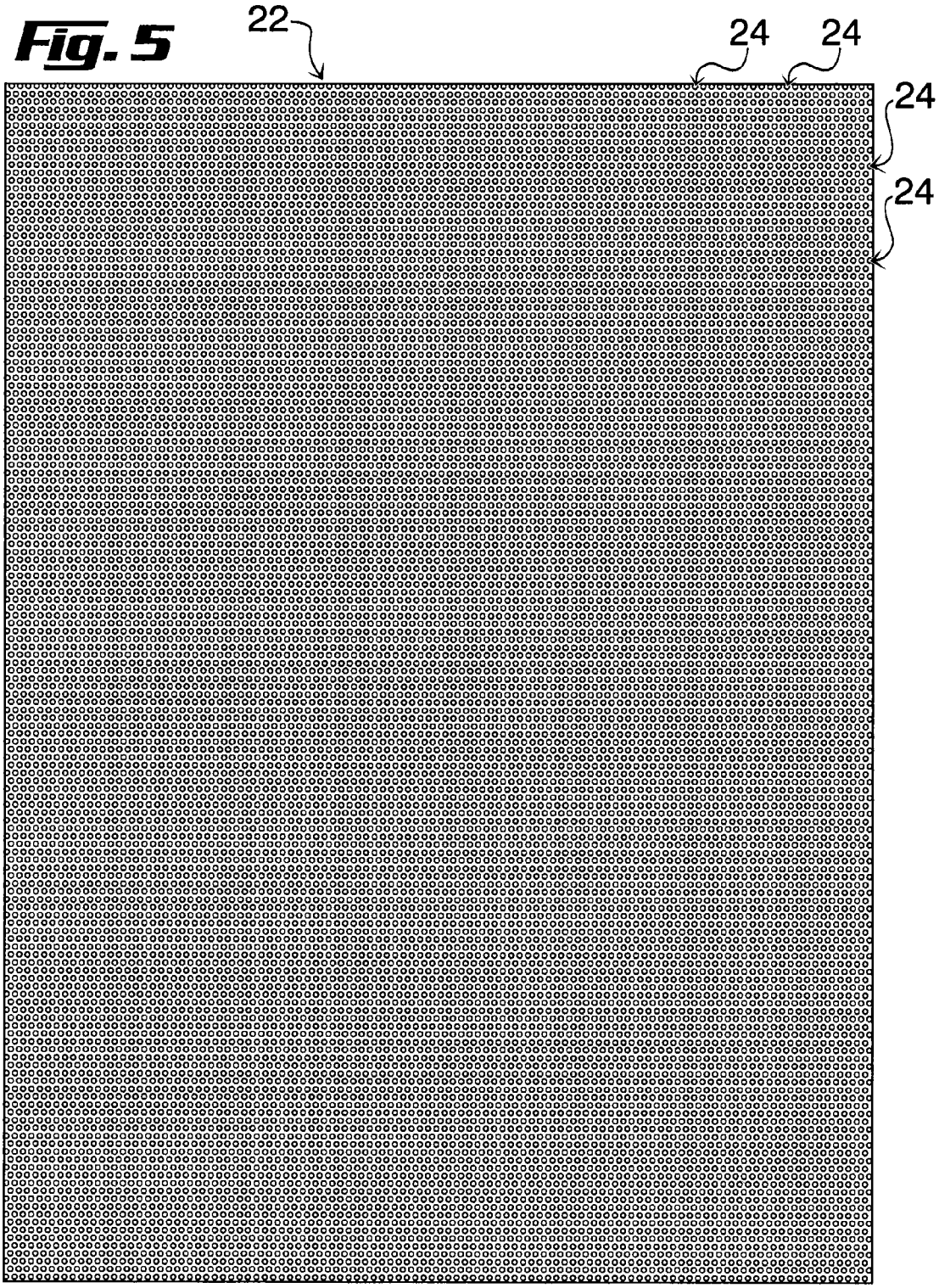
FIG. 5 is a blank of a 'window perforated vinyl' material.
Figure 6:
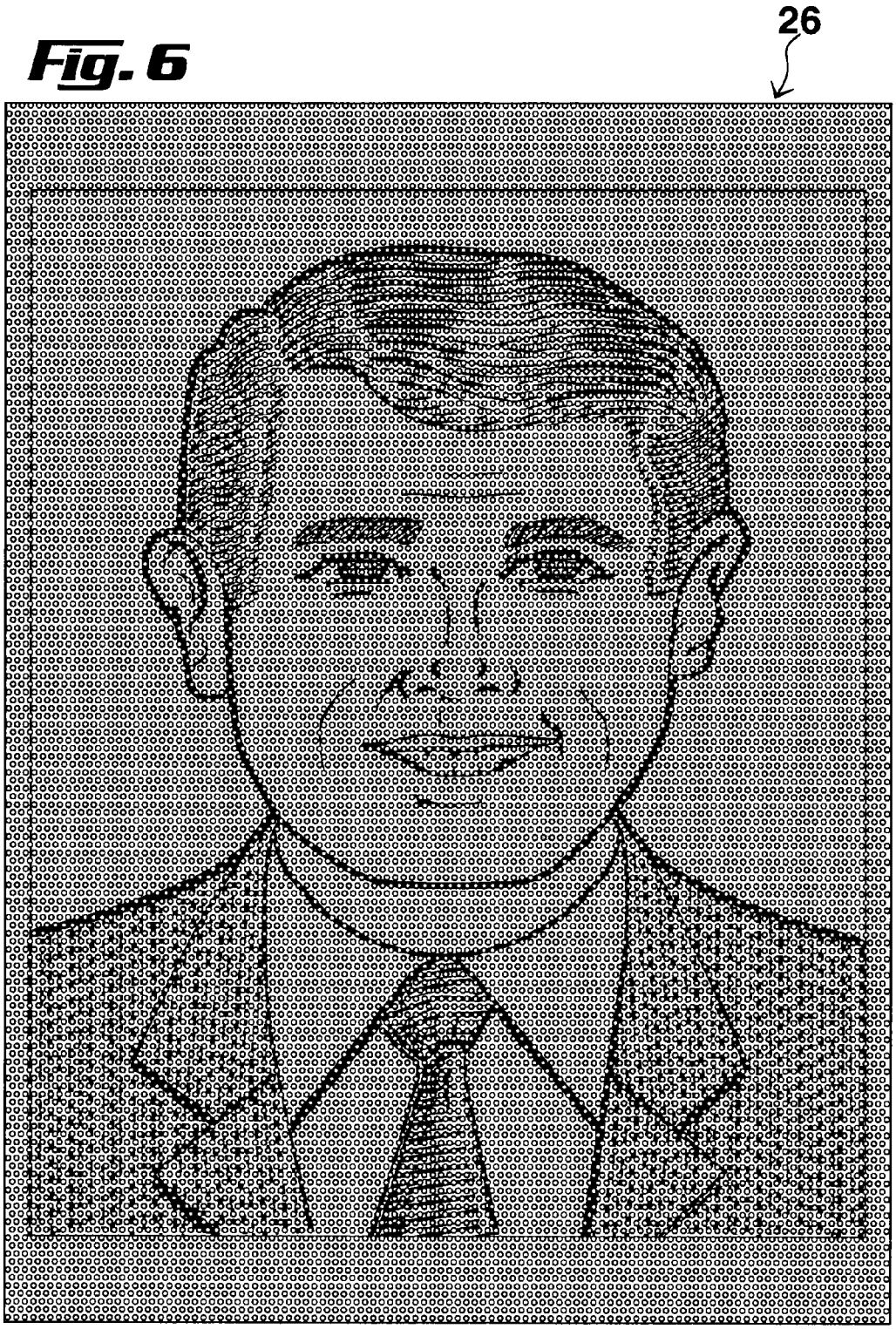
FIG. 6 shows the image of FIG. 4 printed on the blank of the window perforated vinyl material of FIG. 5.

FIG. 5 is a blank of a 'window perforated vinyl' material 22, having a plurality of orifices 24. The orifices may have different sizes and different shapes. The spacings may also vary, and it is also possible to discretionarily alternate different sizes, different shapes and different spacings within one given mask, As shown in FIG. 6, an image is printed on a perforated sheet, resulting in a mask print 26. The sheet may be the clear substrate of the first embodiment example on FIG. 1. FIG. 6 equally illustrates the embodiment of FIG. 2 after the perforations were applied on the 'Window Perforated Vinyl' of FIG. 3.

Likewise, FIG. 6 equally represents a clear sheet 28 (marked 26 in the figure as it is related to another embodiment), wherein 24 represents a plurality of spots void of ink so the transparency of the clear sheet is maintained, and visibility is thereby enabled.

Figure 7:
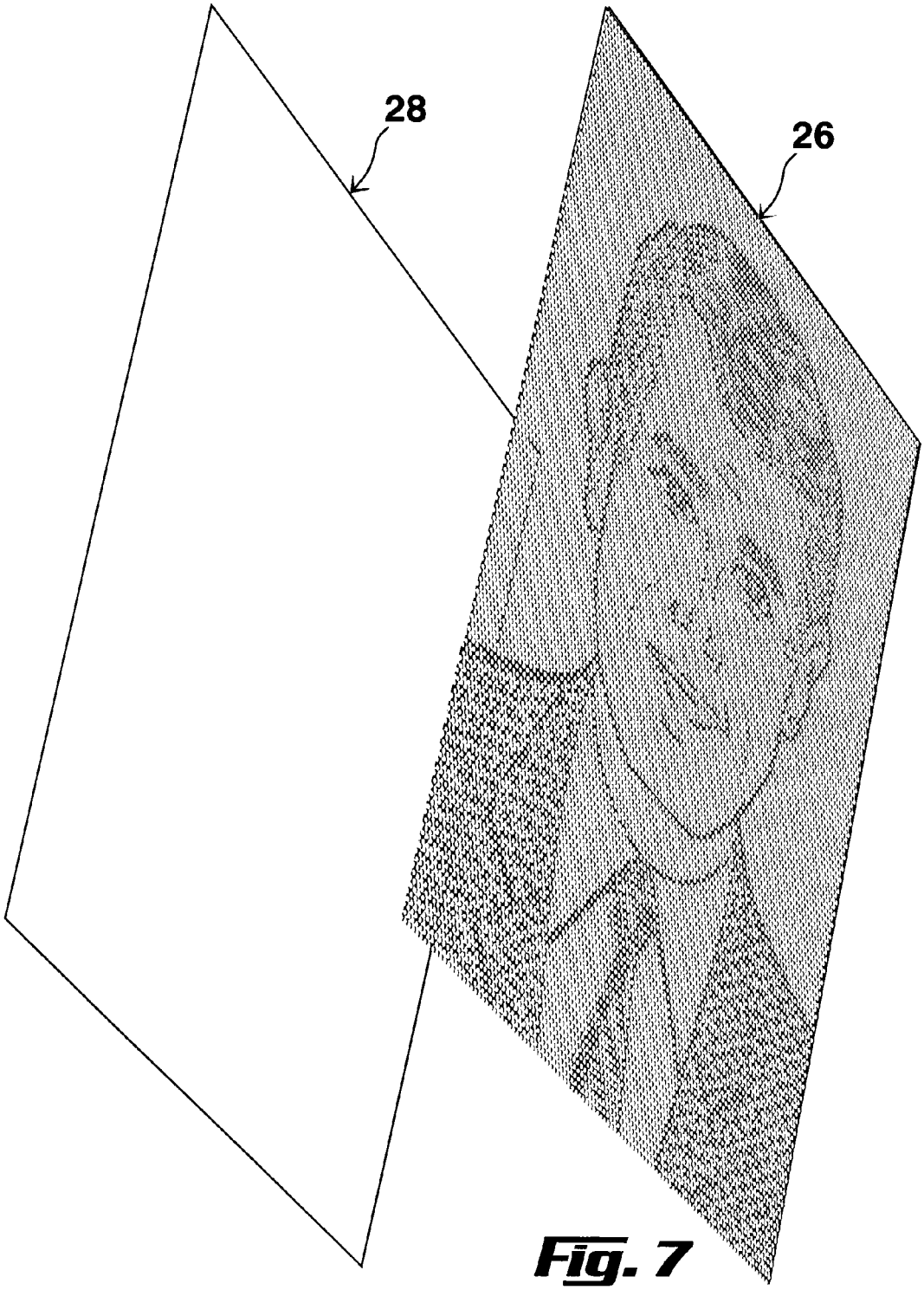
FIG. 7 shows an exploded perspective view of the image of FIG. 4 printed on the blank of the window perforated vinyl material of FIG. 5, and a clear substrate.
Figure 8:
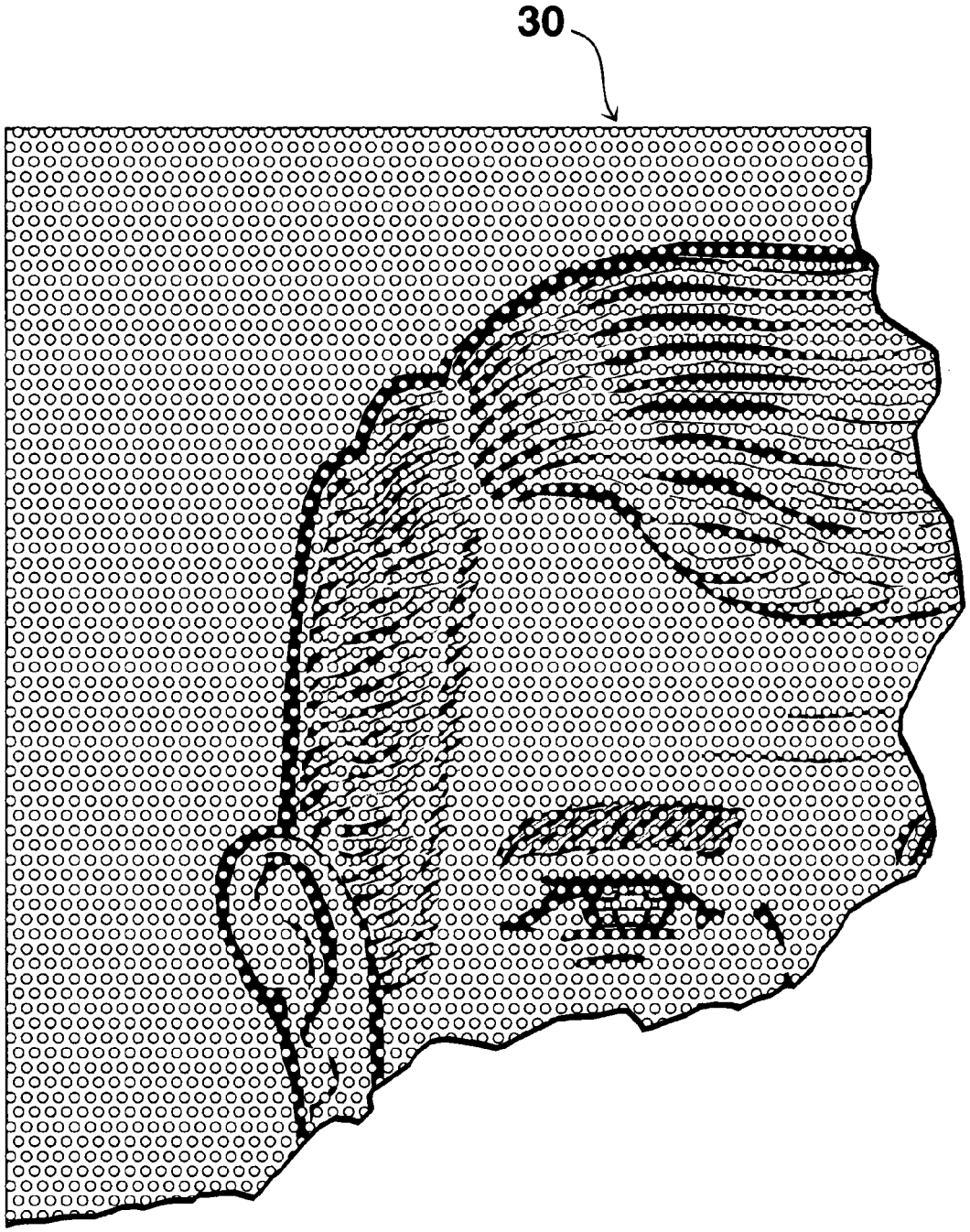
FIG. 8 shows a partial view of FIG. 6 on a larger scale to enhance details.
Figure 9:
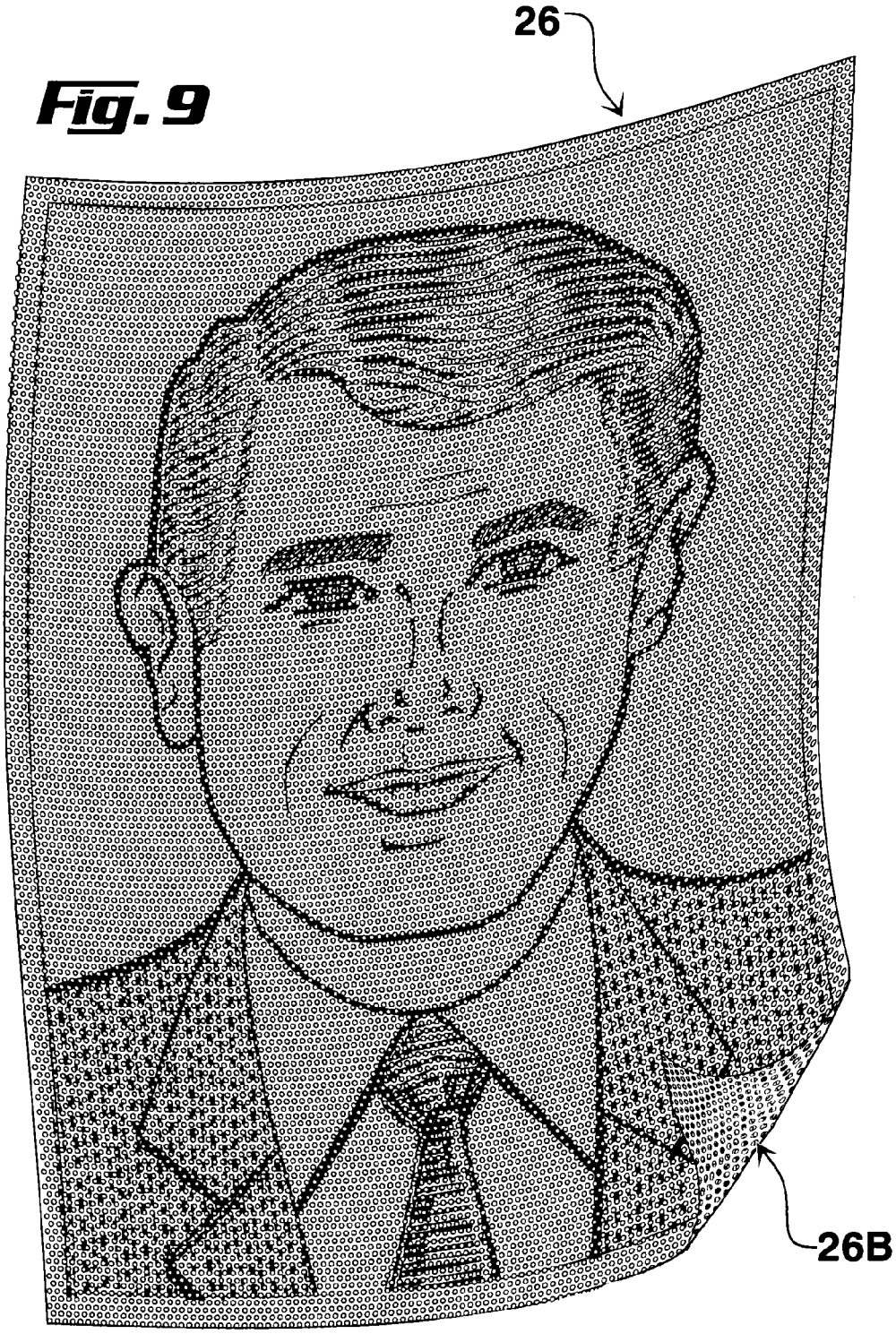
FIG. 9 shows in perspective view a mask being bent.

FIG. 7 shows in exploded view a mask print 26 and a clear substrate 28. The mask print of FIG. 6 is in a cut-out detail, on a larger scale in FIG. 8. And the see through capabilities may be appreciated on the bottom right corner 26B of the sheet in FIG. 9.

A plan view of a mask blank 32 is shown by FIG. 10, and a perspective view of the same, being bent and having an elastic band 34 is depicted by FIG. 11.

FIGS. 12 and 13 show perforations or blank, clear spots 24 restricted to the eyes area.

Figure 14:
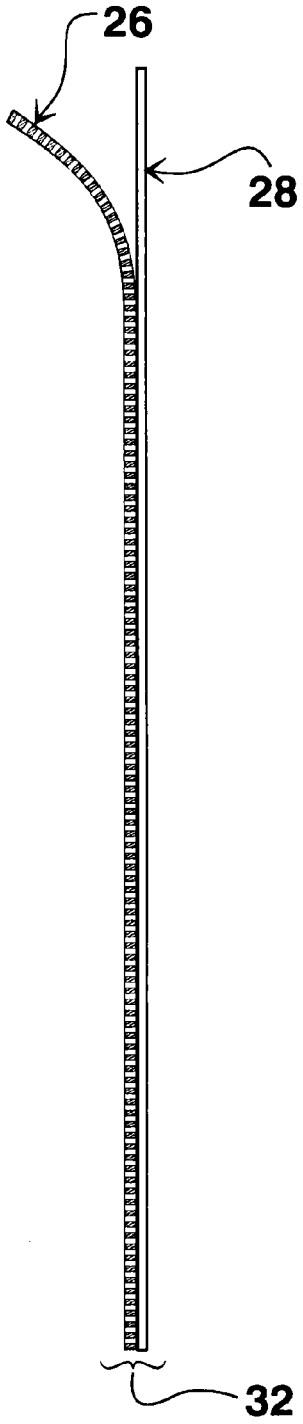
FIG. 14 is a side sectional view of the elements of the mask of the third embodiment example.

A side cross sectional view shows a mask print 26 and a clear substrate of a blank mask 28 in FIG. 14. It is important to note again that in alternate embodiments, the clear substrate will not be necessary. In those embodiments, the see through effect is achieved by perforating small orifices across an opaque material. Also, it is possible to fully print the image on a clear material, leaving no blank spots, and then apply the perforation of the small orifices.

Figure 15:
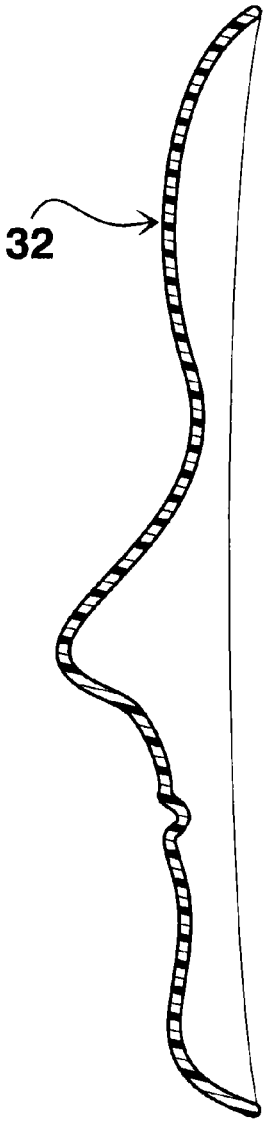
FIG. 15 is a side sectional view of a mask blank having a soft contoured shape.

FIG. 15 corresponds to a profile, cross section view of a mask blank 32, having subtle contours of protrusions and recessions. This can be achieved by two methods. In one scenario, the blank is 'embossed' after printing. In a second scenario, a flexible film is printed and then applied to a preformed clear substrate, as it is commonly done in the packaging and bottling industries. The perforations or clear areas are produced using any of the manners described earlier, according to the method used to produce the contoured shapes.

Figure 16:
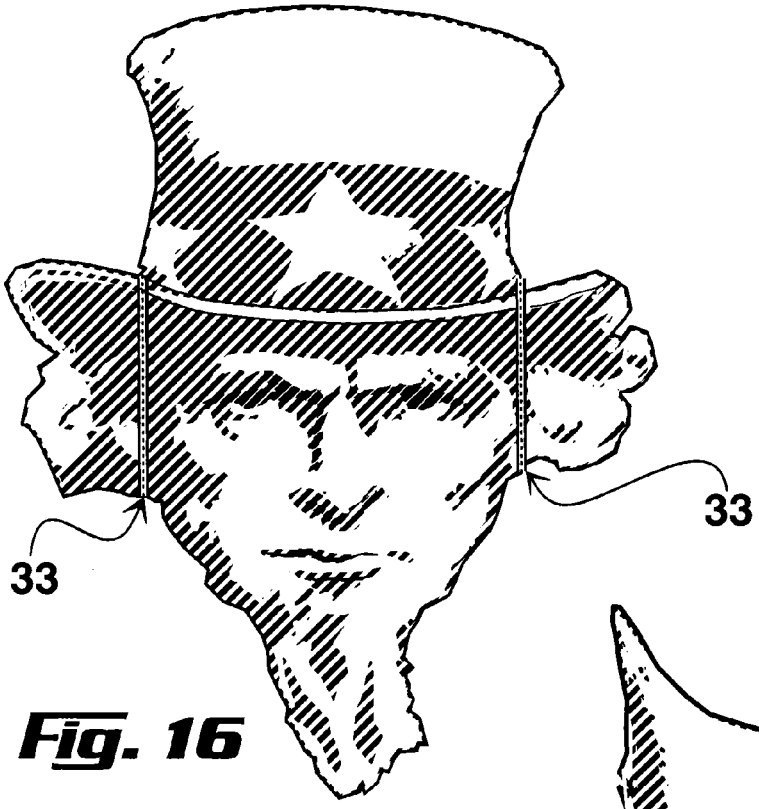
FIG. 16 is a frontal view of a mask having oversized dimensions, further showing score or folding lines. Perforations or blank spots have been obviated so as to not obscure details pertinent to this example.
Figure 17:
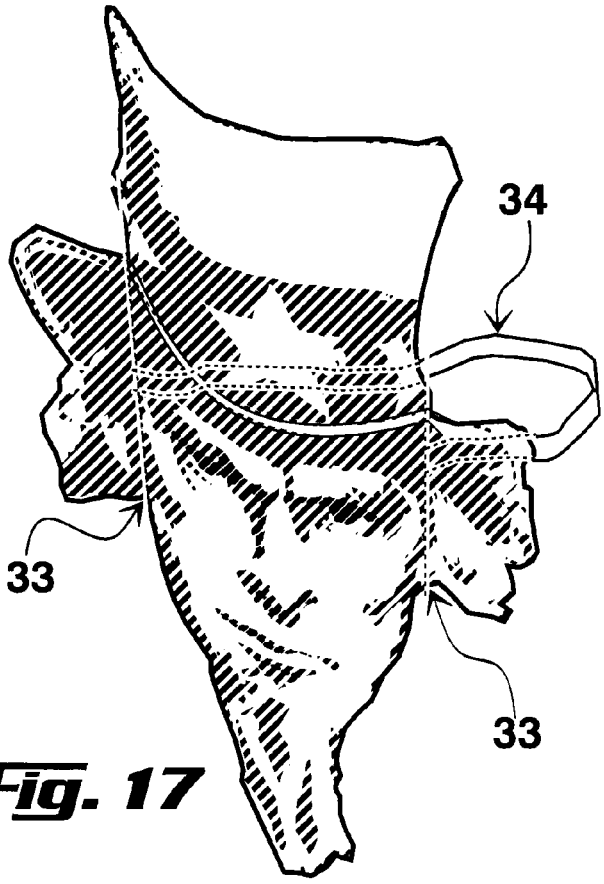
FIG. 17 is the mask of FIG. 16 in perspective view and having been folded along the score lines.

An oversized mask, exceeding the typical width of a person's facial area is shown in FIG. 16. For an enhanced appearance, score lines 33 allow for a gentle bending of the left and right excess of the mask. This will provide a substantially true appearance of the character when seen in plan, frontal view. This example also illustrates the possibility of incorporating additional visual elements to the mask, like a hat and a goatee, for instance. FIG. 16 further shows the same mask being bent along the score lines and having an elastic band 34. Partial phantom lines show the mode of fastening to the mask blank.

Figure 18:
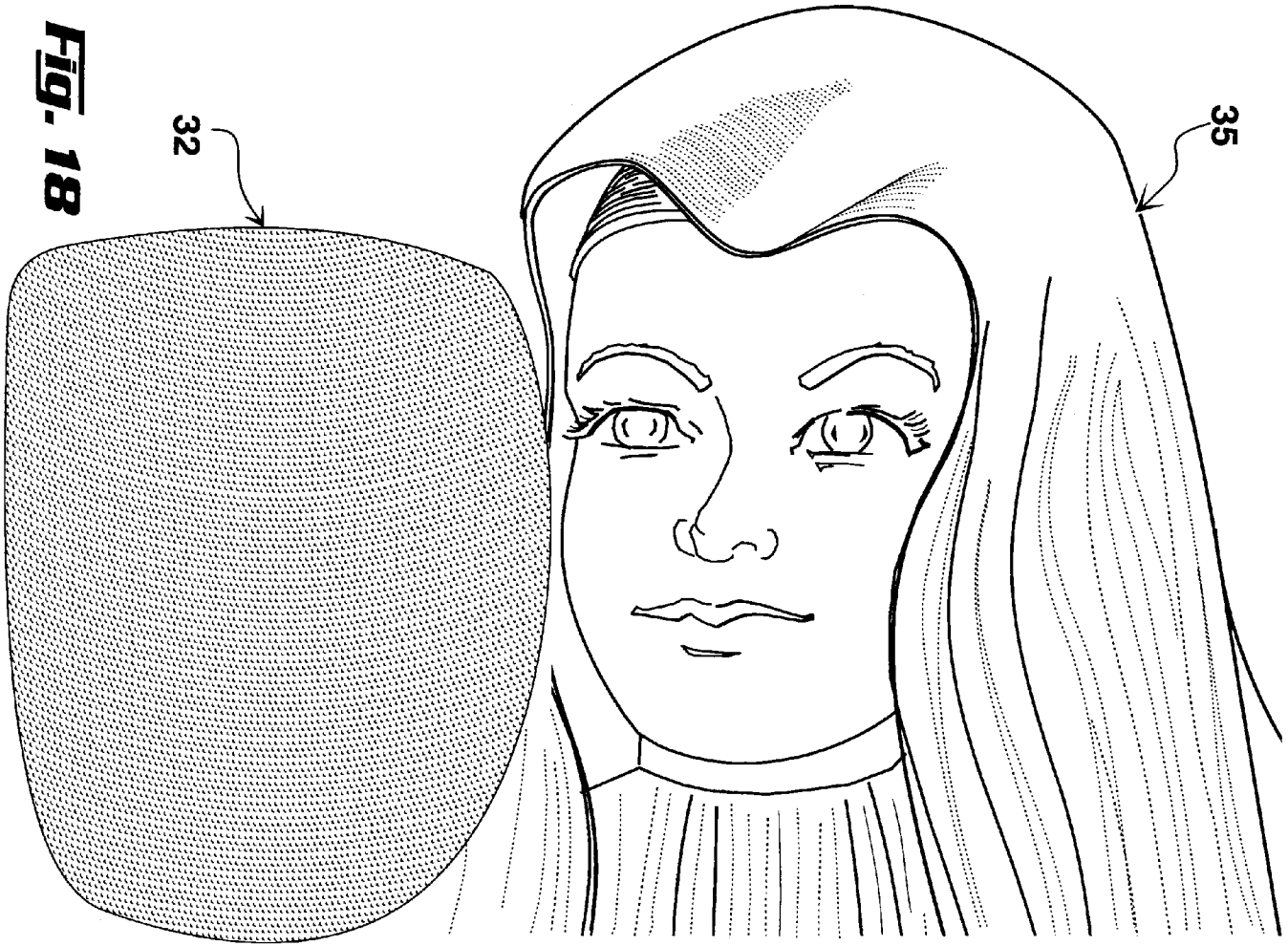
FIG. 18 is an exploded perspective view of a mask with respect to the person that is going to wear it.
Figure 19:
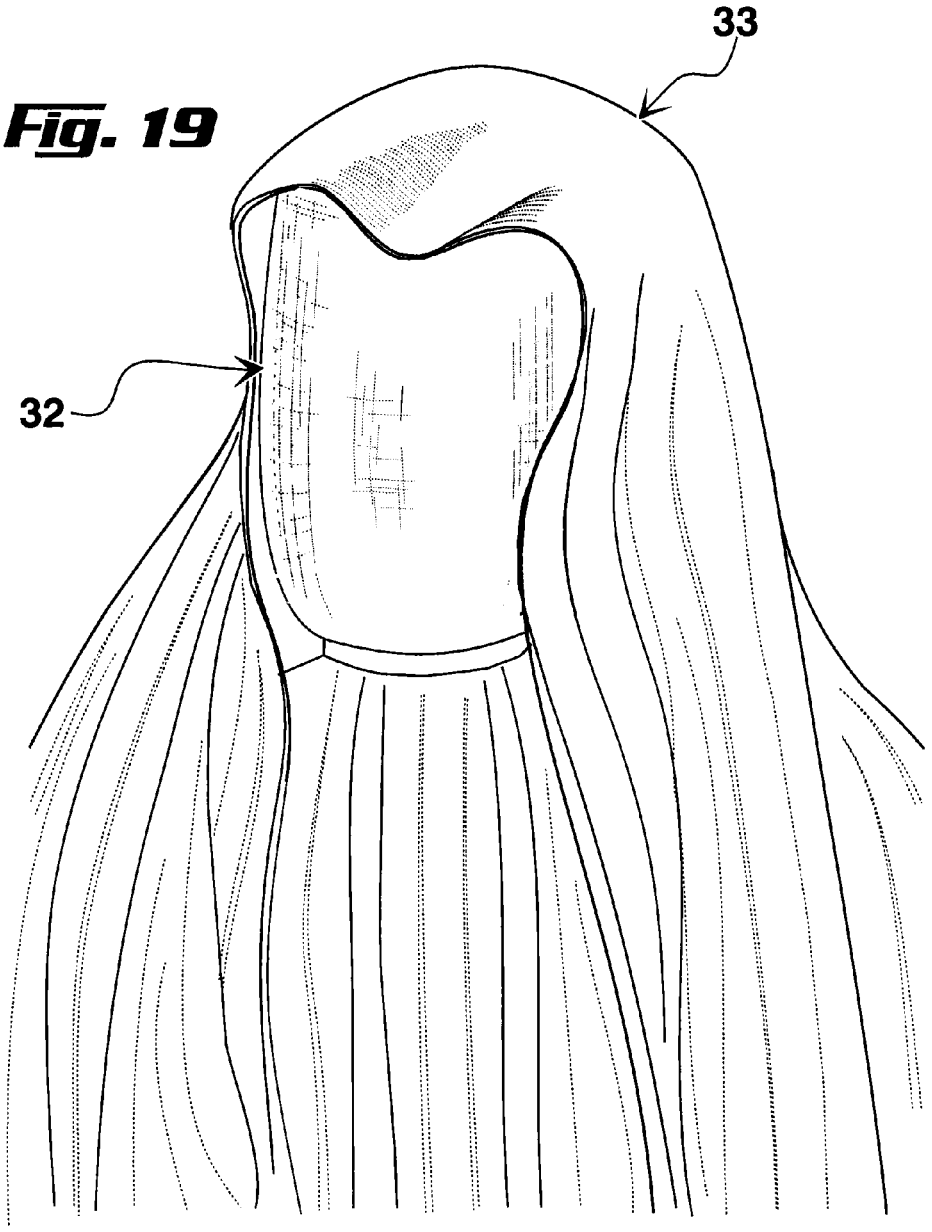
FIG. 19 is a perspective view of a person wearing the mask.

FIGS. 18 and 19 relate to a mask that has no facial or any other kind of features. In this particular example, the mask complements a ghostly costume. FIG. 18 is an exploded view of the mask 32 with respect to the wearer 35. In FIG. 19 the mask is being worn.

Figure 20:
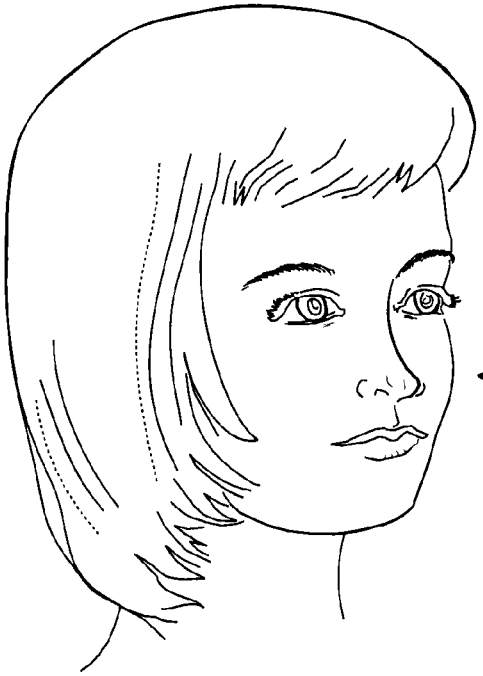
FIG. 20 is a perspective view of the head area of a person.
Figure 21:
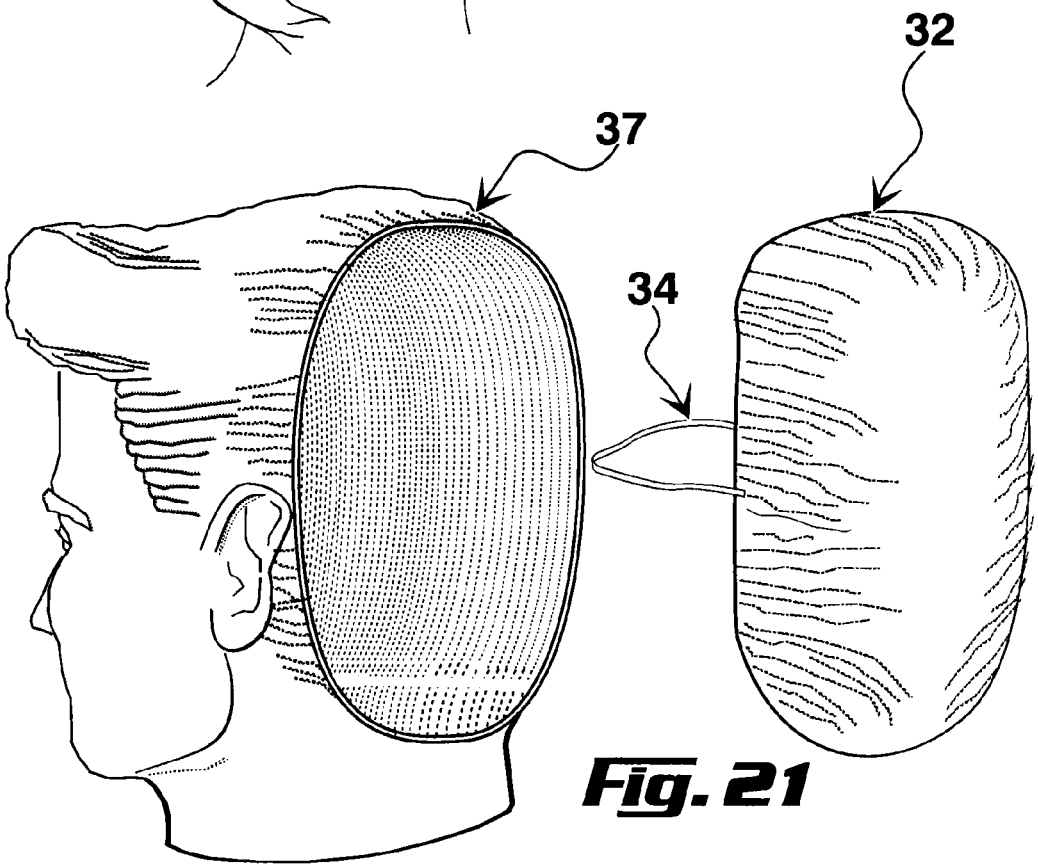
FIG. 21 is an exploded perspective view of a cover for a head and a mask, with no facial features.
Figure 22:
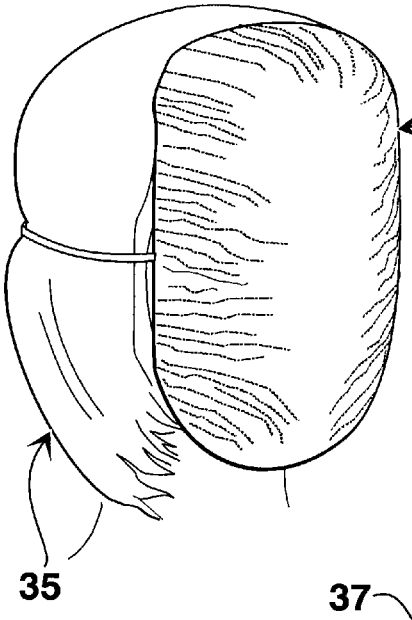
FIG. 22 is a perspective view of the person of FIG. 20 wearing the mask of FIG. 21.
Figure 23:
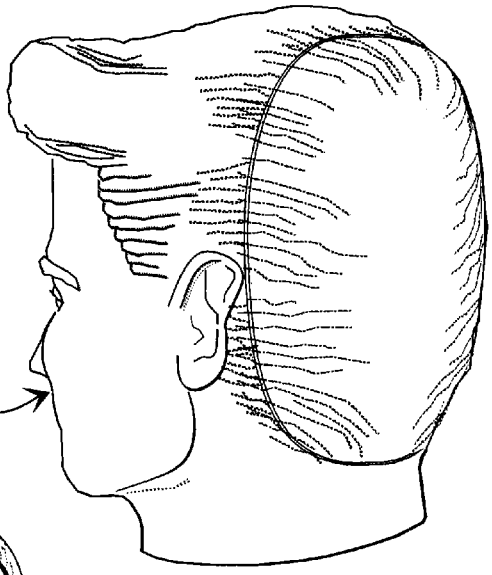
FIG. 23 is a perspective of the person of FIG. 20 now wearing the cover of FIG. 21.
Figure 24:
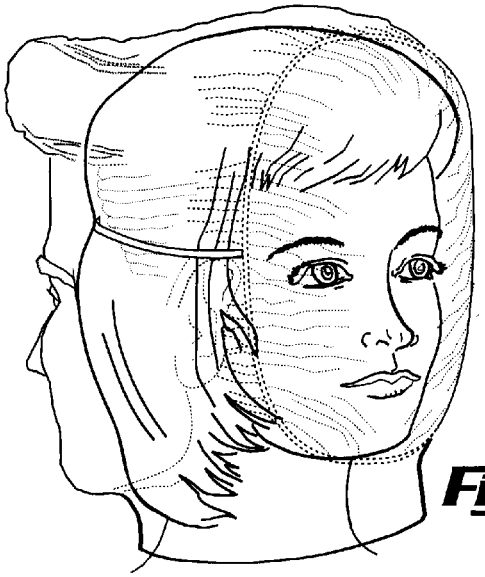
FIG. 24 is the same view of FIG. 23, now allowing visibility of the person through phantom lines.

FIGS. 20-24 inclusive, show the mask cooperating with a head prop to create the illusion of a person having her head twisted 180 degrees. FIG. 20 shows the head area of a female 35. FIG. 21 shows in exploded perspective view a head prop 37 and a mask 32, having an elastic band 34. The mask was mounted on the subject's face, as per FIG. 22. In FIG. 23, the head prop was mounted. FIG. 24 shows the same as FIG. 23, further including details of the female subject visible through phantom lines.

Figure 25:
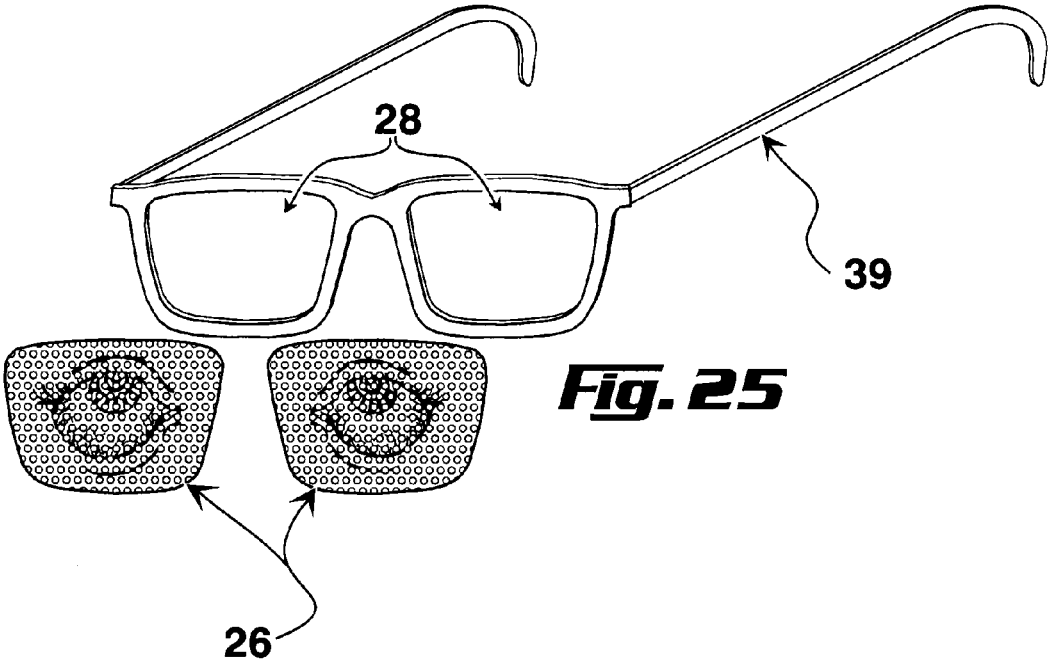
FIG. 25 is a perspective exploded view of an eyeglasses frame and small masks for the eyes section.
Figure 26:
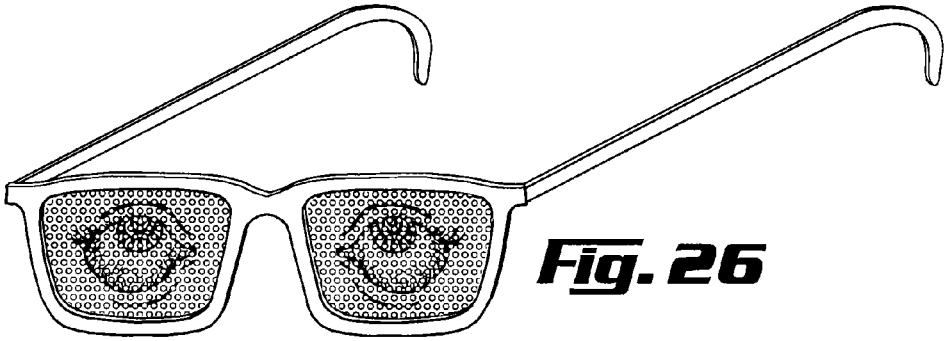
FIG. 26 is the eyeglasses frame of FIG. 25, now having the small masks mounted to the eyes panels.

A partial mask of the present invention is also possible. As shown with FIGS. 25 and 26 an eyeglass-like structure, allows to cover the eyes area of the wearer. FIG. 25 shows in exploded view a frame 39, further having clear substrate panels 28. Masking areas 26 are to be mounted on the structure, as shown in FIG. 26.

While the invention is amenable to various modifications and alternative forms, specifics thereof have been shown by way of example in the drawings and described in some detail. It is understood, however, that the intention is not to limit the invention to the particular embodiments described as way of example. On the contrary, the intention is to cover all modifications, equivalents, and alternatives falling within the spirit and scope of the invention.

Ramifications

The present disclosure provides specific particulars about the invention. It is to be understood that many variations and permutations are possible, within the scope of the invention.

For instance, a mask depicting only the eyes area is possible. In this eventuality, the mask may cooperate with another prop, like a veil, a shade, eye-glasses, a conventional mask, etc.

Likewise, the orifices or blank spots may have any desired shape, or combination of shapes, any predetermined size or combination of sizes, any predetermined distance from one orifice or blank spot to another orifice or blank spot, etc. And of course, different distances between orifices or blank spaces may be alternated. Also, as indicated before, the orifices or blank spots void of any ink or material may be regional only, restricted to the eyes area or may be spread throughout the entire mask blank.

Means to fasten the mask to the wearer include but are not limited to a string, clips or an attachment to a head cover like a hat, hair piece, a handle, etc. The mask may have subtle contours around some protruding and receding facial features like nose, cheek bones, chin, etc.

These features may be obtained by applying pressure and/or heat after the mask has been printed.

Alternatively, if the mask is embodied by imprinting on a flexible material to be adhered to a clear substrate, the first is wrapped around the latter, which has been preformed with some protruding and receding areas, as it is customary in the sign and also in the packaging industries.

Along these lines, the mask may alternatively be attached to a casing covering the rest of the head, and which may also include hair-like props. Additionally any other elements in the public domain may obviously be adapted to the present invention. This includes foil and lenticular effects.

Also, whenever a clear substrate is used to produce a printed mask, the color printing substance or substances may be applied to either one of the two sides of the substrate. If more than one layer of color printing substance is used, the order of printing the color substances is arranged so the final image is properly displayed when the mask is being worn.

Likewise, if a printed layer is going to be mounted on a clear substrate, depending on which side is going to be facing away from the wearer, the adhesive is applied accordingly to the front or the back of the printed layer. As the adhesive is also transparent, it may also be perfectly well applied over the printed image.

As some embodiments and some variations of the mask may require a light color foundation or substrate, for practical purposes, the term 'white' has been used. It is to be understood that this encompasses subtle variations of white, without departing from the spirit of the invention. Similarly, some dark color layer may optionally be applied to the substrate used so it appears on the side of the mask facing the wearer's eyes. For practical purposes the terms 'black' and 'solid black' are to be construed as substantially dark color, so it encompasses subtle variations without departing from the spirit of the invention.

It is to be understood that the mask may be produced using any printing means, and any printing systems, of course including but not limited to Four Color Process, also known as CMYK (Cyan/Magenta/Yellow/Black); RGB (Red/Green/Blue) and any existing technologies, including but not limited to: Silk Screen, Gravure, Offset, Digital printing, Flexography, Stamping, hand painted, etc.

I claim:

1. A mask, comprising:

a) a layer of flexible material having a plurality of orifices,
wherein said layer of flexible material has a first side and a second side,
wherein said first side has printable properties,
wherein said first side is of a substantially white color,
wherein said second side has a coat of pressure sensitive adhesive, b) a release liner layer, c) a clear substrate,
wherein said layer of flexible material is mounted onto said release liner layer,
whereby upon feeding said layer of flexible material mounted onto said release liner layer through a suitable printing system at least one blank of a mask in printed, and
upon separation of said layer of flexible material and said release liner layer, said flexible coat of pressure sensitive adhesive is exposed, and
upon pressing said pressure sensitive adhesive against said clear substrate, at least one assembly of a mask is obtained, d) means to cut said at least one assembly of a mask,
whereby at least one blank of a mask is obtained, e) means to fasten said at least one blank of a mask to a person's face,
whereby a mask is produced.

2. The mask of claim 1, wherein said second side is of a substantially black color.

3. A mask method comprising the steps of:

a) providing a layer of flexible material having a plurality of orifices,
wherein said layer of flexible material has two sides, b) providing printable properties to one of said two sides c) providing a coat of pressure sensitive adhesive to the other one of said two sides d) providing a layer of a release liner, e) mounting said layer of flexible material onto said release liner, so said pressure sensitive adhesive keeps said layer of flexible material and said release liner fastened in a removable manner, f) feeding said layer of flexible material mounted onto said release liner, through a suitable printer, so a blank of at least one mask is printed, g) separating said layer of flexible material and said layer of release liner, h) providing a clear mounting substrate i) pressing said pressure sensitive adhesive to said clear mounting substrate so at least one mask is obtained, j) providing means to peripherally cut said at least one mask, k) providing means to fasten said at least one mask blank to a human face, so said at least one mask is produced.

4. The mask method of claim 3, wherein said one of said two sides of clause b) is substantially of a white color and said other one of said two sides of clause c) is substantially of a black color.

5. A method to produce a see-through mask, comprising the following steps:

a) providing a flexible clear substrate, b) providing an overall substantially white color coating to substantially the entirety of one side of said flexible clear substrate, wherein said overall substantially white color coating has a plurality of areas void of said substantially white color, c) providing sequential halftone coatings of cyan color, magenta color, yellow color and black color so as to produce a four color printing of a pre-selected image on top of said overall substantially white color coating, wherein said sequential halftone coatings of cyan color, magenta color, yellow color and black color have respectively a plurality of areas void of said cyan color, magenta color, yellow color and black color, and which axe in substantial reciprocal registration, and which are in further substantial registration with said plurality of areas void of said overall substantially white color, whereby a see through image is obtained, d) providing means to cut said pre-selected image, whereby a blank of a mask is obtained, e) providing means to mount said blank of a mask to a human face, whereby a see through mask is produced.

6. The method of claim 5, wherein said substantially white color coating is preceded by a substantially black solid color coating, wherein said substantially black solid color, has a plurality of areas void of said substantially black solid color, in such a fashion that said substantially black solid color coating is in close registration with said substantially white color coating.

7. The method system of claim 5, wherein said sequential coatings of clause c) and said overall substantially white color coating of clause b) are printed in inverse order on the other side of said flexible clear substrate.

8. The method of claim 7, wherein a substantially black solid color coating is applied over said substantially white color coating, wherein said substantially black solid color, has a plurality of areas void of said substantially black solid color, in such a fashion that said substantially black solid color coating is in close registration with said substantially white color coating.

9. A see-through mask, comprising:

a) a clear flexible substrate, wherein said clear flexible substrate has b) a sequential printed arrangement of coatings of the following colors: white, cyan, magenta, yellow and black, on one of its two sides, so as to compose an image, wherein each of said sequential printed coatings of white, cyan magenta, yellow and black has a plurality of spots voided of color, wherein said plurality of spots voided of color of each printed coating is in substantial registration with said plurality of spots voided of color of all the other printed coatings, so as to provide see through properties to said image, c) means to peripherally cut said image, whereby a mask blank is obtained, d) means to fasten said mask blank to a face, whereby a see through mask is produced.

10. The see-through mask of claim 9, further comprising a subsequent layer of a substantially black solid color, in substantial registration with said sequential arrangement of coatings of clause b).

11. The see-through mask of claim 9, wherein the order of said sequential printed arrangement of layers in inverted, so image displays on the other one of the two sides of said clear flexible substrate.

12. The see-through mask of claim 11, further comprising the substitution of said cyan color, said magenta color, said yellow color and said black color with at least one spot color.

13. The see-through mask of claim 12, wherein said at least one spot color is selected from a PMS (PANTONE™ MATCHING SYSTEM) chart of colors.

14. The see-through mask of claim 9, wherein said sequential printed arrangement of coatings is preceded by a layer of solid black, wherein said layer of solid black further has a plurality of spots voided of color in close registration with said plurality of spots voided of color of said sequential printed arrangement of layers.

15. A printable mask, comprising:

a) a layer of clear flexible material, wherein said layer of clear flexible, material has a first side and a second side, wherein said first side has printable properties, wherein said second side has a coat of pressure sensitive adhesive, b) a release liner layer, wherein said layer of flexible material is mounted onto said release liner layer, whereby a blank assembly is produced, whereby upon feeding said blank assembly through a printing system a mask image is input, and a sequence of colors is printed as follows;

c1) white color, c2) cyan color, c3) magenta color, c4) yellow color, c5) black color wherein said white color, said cyan color, said magenta color, said yellow color and said black color have areas void of any print, wherein said areas void of any print of said white color, said cyan color, said magenta color, said yellow color and said black color are in substantial reciprocal registration, whereby at least one full color mask is printed while said void areas enable visibility through said flexible material, d) means to cut said at least one full color mask, e) means to fasten said at least one full color mask to a person's face, whereby a mask is produced.

16. The printable mask of claim 15, further comprising the substitution of said cyan color, said magenta color, said yellow color and said black color with at least one spot color.

17. The printable mask of claim 16, wherein said at least one spot color is selected from a PMS (PANTONE™ MATCHING SYSTEM) chart of colors.

18. A printable mask method, comprising the steps of:

a) providing a layer of clear flexible, printable material, wherein said layer of clear flexible, printable material has a first side and a second side, wherein said second side has a coat of pressure sensitive adhesive, b) providing a release liner layer, wherein said layer of flexible material is mounted onto said release liner layer, whereby a blank assembly is produced, whereby upon feeding said blank assembly through a printing system a mask image is input, and a sequence of colors is printed as follows;

c1) white color, c2) cyan color, c3) magenta color, c4) yellow color, c5) black color wherein said white color, said cyan color, said magenta color, said yellow color and said black color have areas void of any print, wherein said areas void of any print of said white color, said cyan color, said magenta color, said yellow color and said black color are in substantial reciprocal registration, whereby at least one full color mask is printed while said void areas enable visibility through said flexible material, d) providing means to cut said at least one full color mask, e) providing means to fasten said at least one full color mask to a person's face, whereby a mask is produced.

19. The printable mask method of claim 18, further comprising the substitution of said cyan color, said magenta color and said yellow color with at least one spot color.

20. The printable mask method of claim 19, wherein said at least one spot color is selected from a PMS (PANTONET™ MATCHING SYSTEM) chart of colors.

* * * * *